US007055729B2

(12) United States Patent
Taylor et al.

(10) Patent No.: US 7,055,729 B2
(45) Date of Patent: Jun. 6, 2006

(54) TOOL-FREE DEPTH-OF-DRIVE ADJUSTMENT FOR A FASTENER-DRIVING TOOL

(75) Inventors: Walter J. Taylor, McHenry, IL (US); Maureen L. Shea, Wilmette, IL (US); William J. Heinzen, Glenview, IL (US); James A. Purpura, Cary, IL (US); Barry C. Walthall, Wheeling, IL (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 10/949,170

(22) Filed: Sep. 24, 2004

(65) Prior Publication Data

US 2006/0065692 A1 Mar. 30, 2006

(51) Int. Cl.
*B25C 1/04* (2006.01)

(52) U.S. Cl. ..... 227/142; 227/8

(58) Field of Classification Search ..... 227/142, 227/8, 120, 130

See application file for complete search history.

(56) References Cited

U.S. PATENT DOCUMENTS 3,519,186 A * 7/1970 Volkmann ..... 227/8
4,327,485 A 5/1982 Rix
4,405,071 A 9/1983 Austin
4,483,474 A 11/1984 Nikolich
4,767,043 A 8/1988 Canlas, Jr.
5,083,694 A 1/1992 Lemos
5,207,143 A 5/1993 Monacelli
5,219,110 A 6/1993 Mukoyama
5,261,587 A 11/1993 Robinson
5,263,626 A * 11/1993 Howard et al. ..... 227/8
5,263,842 A 11/1993 Fealey
5,385,286 A 1/1995 Johnson, Jr.
5,447,265 A 9/1995 Vidal et al.
5,484,094 A 1/1996 Gupta
5,564,614 A 10/1996 Yang
5,579,977 A 12/1996 Yang
5,667,127 A 9/1997 Ichikawa et al.
5,685,473 A 11/1997 Shkolnikov et al.
5,785,227 A 7/1998 Akiba
5,816,468 A 10/1998 Yang
5,839,638 A 11/1998 Ronn
6,012,622 A 1/2000 Weinger et al.
6,024,267 A 2/2000 Chen
6,170,729 B1 1/2001 Lin
6,179,192 B1 1/2001 Weinger et al.
6,186,386 B1 2/2001 Canlas et al.
6,209,770 B1 * 4/2001 Perra ..... 227/8
6,422,446 B1 7/2002 Liu (Continued)

*Primary Examiner*—Scott A. Smith
(74) *Attorney, Agent, or Firm*—Lisa M. Soltis; Mark W. Croll; Greer, Burns & Crain, Ltd.

(57) ABSTRACT

An adjustable depth of drive assembly for use with a fastener-driving tool includes a workpiece contact element having a contact end and an adjustment end, at least one stop configured for being secured to the tool and being normally moveable between an adjusting position in which the workpiece contact element is movable relative to the tool, and a locked position where the adjustment end is secured from movement relative to the tool, and at least one biasing element associated with the stop and configured for urging the stop and the adjustment end into a selected locked position relative to the tool without the use of tools.

20 Claims, 3 Drawing Sheets

U.S. PATENT DOCUMENTS 6,427,896 B1 8/2002 Ho et al.
6,557,745 B1 5/2003 Wang
6,581,815 B1 * 6/2003 Ho et al. ..... 227/142
6,695,192 B1 2/2004 Kwok
6,705,501 B1 3/2004 Miller et al.
6,763,992 B1 7/2004 Hirai
6,783,044 B1 8/2004 Perra et al.
6,866,177 B1 * 3/2005 Chen ..... 227/142
6,988,648 B1 1/2006 Taylor et al.
2005/0189390 A1 9/2005 Taylor et al.

* cited by examiner

TOOL-FREE DEPTH-OF-DRIVE ADJUSTMENT FOR A FASTENER-DRIVING TOOL

BACKGROUND OF THE INVENTION

The present invention relates generally to fastener-driving tools used to drive fasteners into workpieces, and specifically to combustion-powered fastener-driving tools, also referred to as combustion tools. More particularly, the present invention relates to improvements in a device or assembly that adjusts the depth-drive of the tool.

As exemplified in Nikolich, U.S. Pat. Re. Ser. No. 32,452, and U.S. Pat. Nos. 4,552,162; 4,483,473; 4,483,474; 4,404,722; 5,197,646; 5,263,439; 5,558,264 and 5,678,899 all of which are incorporated by reference, fastening tools, and particularly, portable combustion-powered tools for use in driving fasteners into workpieces are described. Such fastener-driving tools are available commercially from ITW-Paslode (a division of Illinois Tool Works, Inc.) of Vernon Hills, Ill., under the IMPULSE® and PASLODE® brands.

Such tools incorporate a tool housing enclosing a small internal combustion engine. The engine is powered by a canister of pressurized fuel gas, also known as a fuel cell. A battery-powered electronic power distribution unit produces the spark for ignition, and a fan located in the combustion chamber provides for an efficient combustion within the chamber, and facilitates scavenging, including the exhaust of combustion by-products. The engine includes a reciprocating piston having an elongate, rigid driver blade disposed within a piston chamber of a cylinder body.

The wall of a combustion chamber is axially reciprocable about a valve sleeve and, through a linkage, moves to close the combustion chamber when a workpiece contact element at the end of a nosepiece connected to the linkage is pressed against a workpiece. This pressing action also triggers a fuel-metering valve to introduce a specified volume of fuel gas into the closed combustion chamber from the fuel cell.

Upon the pulling of a trigger, a charge of gas in the combustion chamber of the engine is ignited, causing the piston and driver blade to be shot downward to impact a positioned fastener and drive it into the workpiece. As the piston is driven downward, a displacement volume enclosed in the piston chamber below the piston is forced to exit through one or more exit ports provided at a lower end of the cylinder. After impact, the piston returns to its original, or "ready" position through differential gas pressures within the cylinder. Fasteners are fed into the nosepiece from a supply assembly, such as a magazine, where they are held in a properly positioned orientation for receiving the impact of the driver blade. The power of these tools differs according to the length of the piston stroke, volume of the combustion chamber, fuel dosage and similar factors.

Combustion-powered tools have been successfully applied to large workpieces requiring large fasteners, such as for framing, roofing and other heavy-duty applications. Smaller workpiece and smaller fastener trim applications demand a different set of operational characteristics than the above-identified heavy-duty applications. Other types of fastener-driving tools such as pneumatic, powder activated and/or electrically powered tools are well known in the art, and are also contemplated for use with the present depth-of-drive adjustment assembly.

One operational characteristic required in fastener-driving applications, particularly in trim applications, is the ability to predictably control fastener-driving depth. For the sake of appearance, some trim applications require fasteners to be countersunk below the surface of the workpiece, others require the fasteners to be sunk flush with the surface of the workpiece, and some may require the fasteners to stand off above the surface of the workpiece. Depth adjustment has been achieved in pneumatically powered and combustion powered tools through a tool controlling mechanism, known as a drive probe, which is movable in relation to the nosepiece of the tool. Its range of movement defines a range for fastener depth-of-drive. Similar depth-of-drive adjustment mechanisms are known for use in combustion-type framing tools.

A conventional arrangement for depth adjustment involves the use of respective overlapping plates or tongues of a workpiece contact element and an upper probe or wire form. At least one of the plates is slotted for sliding relative to length adjustment. Threaded fasteners such as cap screws are employed to releasably secure the relative position of the plates together. The depth-of-fastener-drive is adjusted by changing the length of the workpiece contact element relative to the upper probe. Once the desired depth is achieved, the fasteners are tightened.

It has been found that users of such tools are inconvenienced by the requirement for an Allen wrench, nut driver, screwdriver or comparable tool for loosening the fasteners, and then retightening them after length adjustment has been completed. In operation, it has been found that the extreme shock forces generated during fastener-driving cause the desired and selected length adjustment to loosen and vary. Thus, the fasteners must be monitored for tightness during tool use.

To address the problem of maintaining adjustment, grooves or checkering have been added to the opposing faces of the overlapping plates to increase adhesion when the fasteners are tightened. However, to maintain the strength of the components in the stressful environment of fastener driving, the grooves must be made deep enough to provide the desired amount of adhesion. Deeper grooves could be achieved without weakening the components by making the plates thicker, but that would add weight to the linkage, which is undesirable.

Other attempts have been made to provide tool-free depth-of-drive adjustment, but they have also employed the above-described opposing face grooves for additional adhesion, which is still prone to the adhesion problems discussed above.

Another design factor of such depth adjustment or depth-of-drive (used interchangeably) mechanisms is that the workpiece contact elements are often replaced over the life of the tool. As such, the depth adjustment mechanism preferably accommodates such replacement while retaining compatibility with the upper probe of the tool, which is not necessarily replaced.

Accordingly, there is a need for an improved fastener-driving tool depth-of-drive adjustment assembly where the adjustment is secured without the use of tools and is maintained during extended periods of fastener driving. There is also a need for an improved fastener depth adjustment assembly which provides for more positive fastening of the relative position of the workpiece contact element without reducing component strength. Finally, there is a need for an improved fastener depth-of-drive assembly which can be replaced when the life of the workpiece contact element has expired without requiring the replacement of the entire fastener-driving tool.

BRIEF SUMMARY OF THE INVENTION

The above-listed needs are met or exceeded by the present tool-free depth-of-drive adjustment assembly for a fastener-driving tool. Among other things, the present assembly is designed for more securely retaining the workpiece contact element relative to an upper probe linkage during tool operation, while at the same time allowing for adjustment by the user without the use of tools.

More specifically, an adjustable depth of drive assembly for use with a fastener-driving tool is provided and includes a workpiece contact element having a contact end and an adjustment end, at least one stop configured for being secured to the tool and being normally moveable between an adjusting position in which the workpiece contact element is movable relative to the tool, and a locked position where the adjustment end is secured from movement relative to the tool, and at least one biasing element associated with the stop and configured for urging the stop and the adjustment end into a selected locked position relative to the tool without the use of tools.

DETAILED DESCRIPTION OF THE INVENTION

Figure 1:
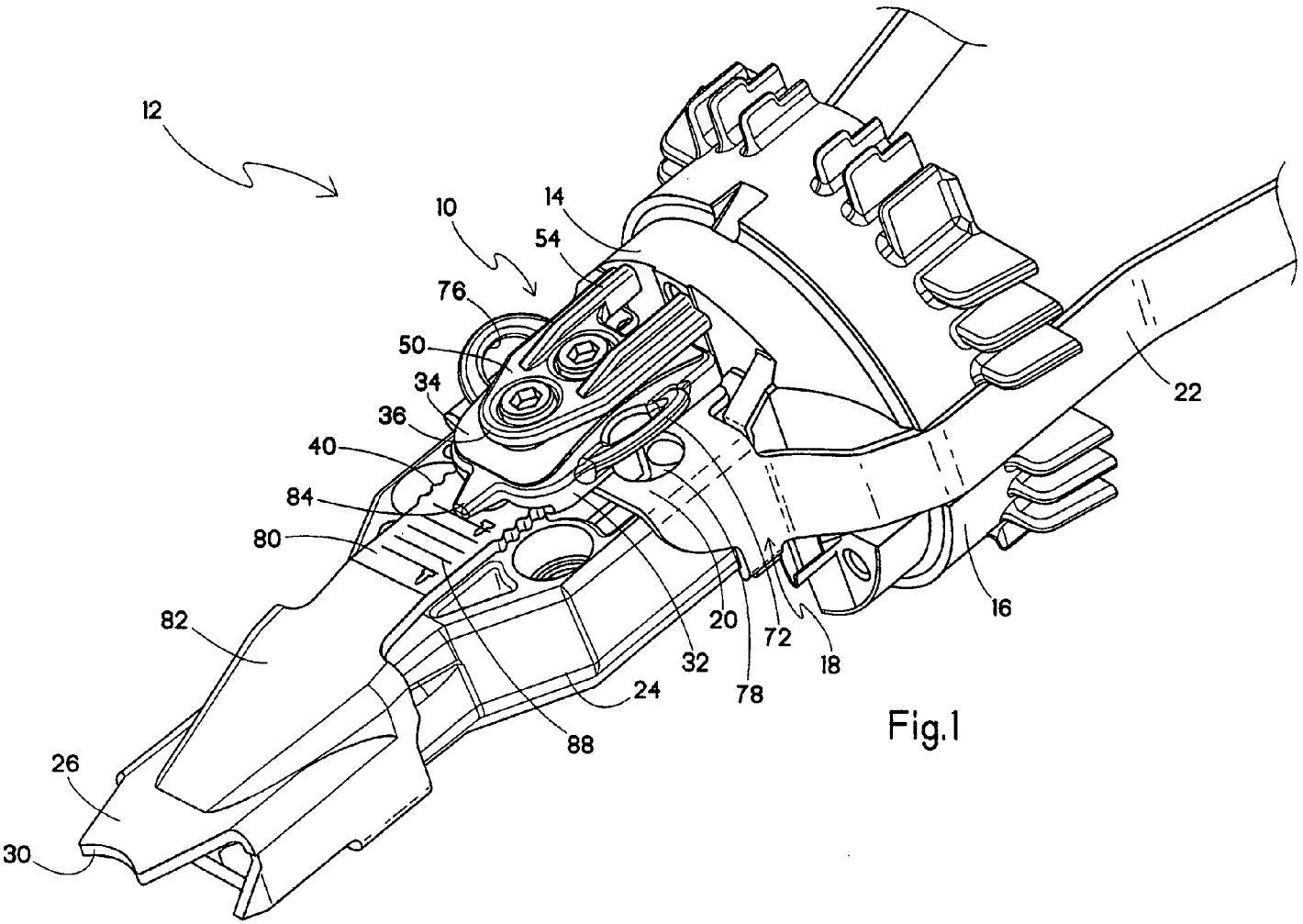
FIG. 1 is a perspective view of a fastener-driving tool equipped with the present depth-of-drive adjustment assembly shown in the locked position.

Referring now to FIG. 1, an improved adjustable depth-of-drive assembly is generally designated 10, and is intended for use on a fastener-driving tool of the type described above, and generally designated 12. The tool 12 includes a beauty ring 14 that is attached to a bottom end of a cylinder body 16. In this application, "beauty ring" refers to a rigid lower portion of the tool's combustion engine, and is typically fitted with an ornamental cap or facia (not shown). An upper probe 18 has a platform 20 and a pair of elongate arms 22 which are connected at free ends to a reciprocating valve sleeve (not shown) as is known in the art. In the preferred embodiment, the upper probe 18 is fabricated by being stamped and formed from a single piece of metal, however other rigid durable materials and fabrication techniques are contemplated.

The tool 12 further includes a nosepiece 24 that is fixed relative to the beauty ring 14 and the cylinder body 16. The nosepiece 24 is configured for receiving fasteners from a magazine (not shown), as is known in the art. A workpiece contact element 26 is configured for reciprocal sliding movement relative to the nosepiece 24, and preferably surrounds the nosepiece on at least three sides.

The present depth-of-drive assembly 10 is configured for adjusting the relative position of the workpiece contact element 26 to the upper probe 18, which in turn alters the relative position of the workpiece contact element to the nosepiece 24. Generally, as the nosepiece 24 is brought closer to a workpiece surface, fasteners driven by the tool 12 are driven deeper into the workpiece.

The workpiece contact element 26 includes a tongue portion or an adjustment end 28 (best seen in FIG. 2) and a contact end 30 opposite the adjustment end 28. The contact end 30 extends past the nosepiece 24, and as is known in the art, contacts the workpiece surface into which the fastener is to be driven. While stamping a single piece of metal is a preferred construction for the workpiece contact element 26, other methods of fabrication are contemplated as are known in the art.

Figure 2:
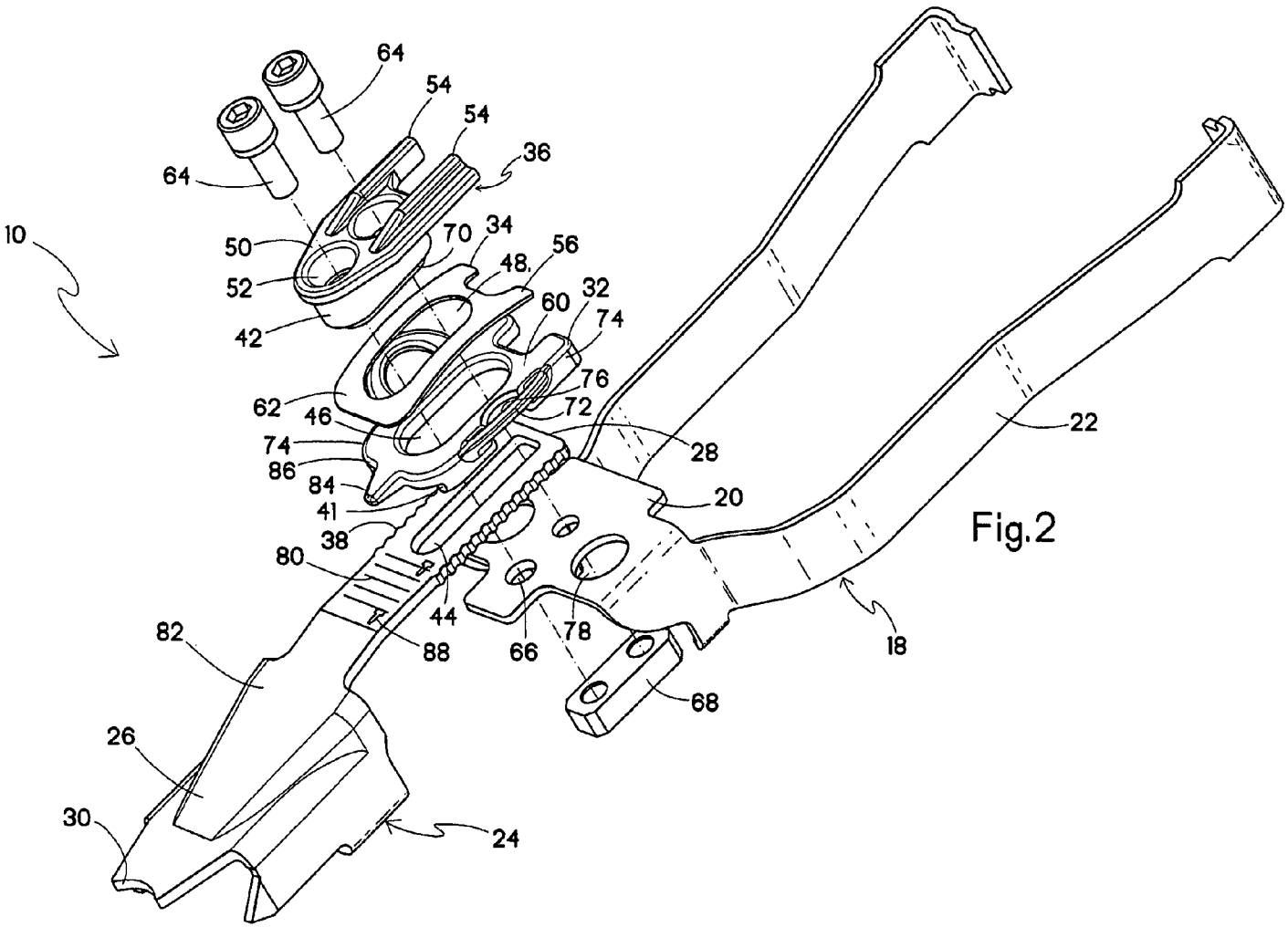
FIG. 2 is an exploded perspective view of the assembly of FIG. 1.
Figure 3:
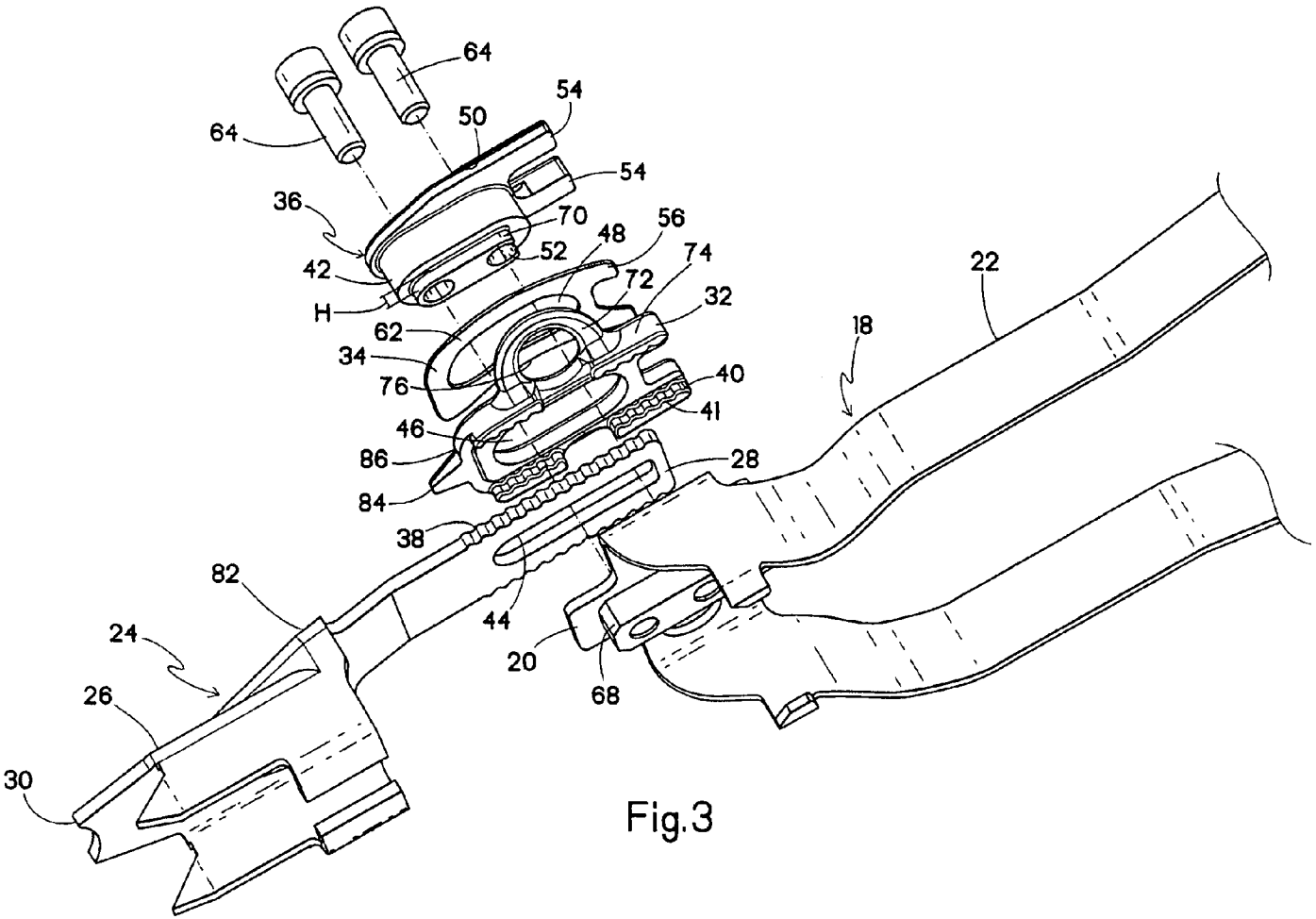
FIG. 3 is an exploded bottom perspective view of the assembly of FIG. 1.

Turning now to FIGS. 2 and 3, the present depth-of-drive assembly 10 is configured for being fastened to the platform 20 of the upper probe 18 of the fastener-driving tool 12 and further includes a stop 32 that is configured for being removably engaged with the workpiece contact element 26. A biasing element 34 is configured for exerting a biasing force against the stop 32, urging the stop in a normal direction relative to the movement of the workpiece contact element 26 and into engagement with the workpiece contact element. A spacer 36 is constructed and arranged for compressing the biasing element 34 against the stop 32.

In the present depth-of-drive assembly 10, the adjustment end 28 of the workpiece contact element 26 has at least one toothed edge 38, and the stop 32 has at least one corresponding toothed surface 40 configured for positively engaging the toothed edge 38 in one of a plurality of selected adjustment positions. Preferably, the stop 32 has a depending skirt 41, and the at least one toothed surface 40 is disposed on the skirt. Furthermore, in the preferred embodiment, the adjustment end 28 of the workpiece contact element 26 includes two, generally parallel toothed edges 38, and a corresponding one of the at least one toothed surfaces 40 on the skirt 41 is configured to engage each of the toothed edges on the workpiece contact element 26.

The spacer 36 includes a base 42 configured to be received by an opening 44 in the adjustment end 28 of the workpiece contact element 26. In addition, the stop 32 has an opening 46 configured to be in registry with the opening 44 in the workpiece contact element 26. An opening 48 in the biasing element 34 is configured to be in registry with the opening 46 in the stop 32. In the present depth-of-drive assembly 10, the spacer base 42 is configured for being received by each of the opening 48 in the biasing element 34, the opening 46 in the stop 32, and the opening 44 in the workpiece contact element 26. A mating relationship between the base 42 and the openings 46 and 48 prevents the biasing element 34 and the stop 32 from moving axially along the workpiece contact element 26 relative to the base.

In the present depth-of-drive assembly 10, the spacer 36 also includes a flange 50 and a pair of throughbores 52 extending through both the flange and the spacer base 42. In addition, the flange 50 includes at least one axially extending bumper formation 54. Preferably, a pair of bumper formations 54 is provided in a generally parallel, spaced relationship. However, the number and orientation of such formations may vary to suit the application. When the present depth-of-drive assembly 10 is connected to the fastener-driving tool 12, the at least one bumper formation 54 is configured to abut against the beauty ring 14 of the fastener-driving tool 12.

As is seen in FIGS. 2 and 3, the at least one bumper formation 54 extends further axially in a direction opposite the contact end 30 than corresponding back ends 56, 58 of the biasing element 34 and the stop 32. Therefore, only the at least one bumper formation 54 comes into contact with the beauty ring 14. Unlike prior art depth adjustment systems, which often caused the tool to go out of adjustment upon exposure to operational forces, there is no contact between the stop 32 and the beauty ring 14 in the present configuration. The configuration of the at least one bumper formation 54 helps to keep the present assembly 10 from shifting during operation, and also keeps the biasing element 34 in a compressed state between the spacer 36 and the stop 32.

The biasing element 34 is preferably convex in shape, and is configured to keep tension on the stop 32. It is contemplated that the convex biasing element 34 provides a stronger or more robust linkage between the upper probe 18 and the nosepiece 24, thereby maintaining the desired depth of adjustment of the tool 12 during operation. It is further contemplated that the biasing element 34 is formed out of a single piece of metal by stamping, but other methods of fabrication are contemplated as is known in the art.

The biasing element 34 is disposed between the flange 50 and a front surface 60 of the stop 32. While other types of springs are contemplated, the biasing element is a relatively flat piece of spring steel with an arched or preloaded side profile. A convex surface 62 is preferably disposed adjacent the flange 50. The biasing element 34 provides sufficient biasing force to urge the stop 32 against the adjustment end 28 of the work contact element 26 so that the corresponding teeth 40, 38 are tightly meshed together.

The present assembly 10 further includes at least one and preferably a pair of fasteners 64 configured for being inserted into the pair of spacer through-bores 52. The upper probe platform 20 includes at least one and preferably a pair of platform openings 66 that are configured to register with the spacer holes 52. The fasteners 64 are configured for fastening the present depth of drive assembly 10 to the upper probe platform 20 of the fastener-driving tool 12. After the fasteners 64 are inserted through both the spacer holes 52 and the platform openings 66 of the upper probe 18, the fasteners threadably engage and are tightened into a nut block 68, as is known in the art. Upon tightening of the fasteners 64 into the nut block 68, the present assembly 10 is securely fastened to the tool 12.

Once the fasteners 64 are tightened into the nut block 68, a lower undercut 70 on the spacer 36 defines a height "H" which generally corresponds to the thickness of the adjustment end 28. While the stop 32 is prevented from movement along the axis of the workpiece contact element 26, the adjustment end 28 and with it the workpiece contact element, is axially slidable relative to the fastened spacer 36, as well as the biasing element 34 and the stop 32.

Referring again to FIGS. 2 and 3, in the present assembly 10, the stop 32 further includes a pair of outwardly extending ears 72 located on a pair of opposite sides 74 of the stop 32. The ears 72 include openings 76 (best seen in FIG. 3) that are configured to allow the operator of the tool access to so-called "quick-clear" screws (not shown) located in the nosepiece 24 and accessible through a pair of quick-clear holes 78 located on the upper probe platform 20. It is contemplated that the ears 72 are dimensioned to facilitate access for cleaning out debris that may form between the stop 32 and the adjustment end 28 of the workpiece contact element 26. It is preferred that the stop 32 be manufactured by means of MIM, which could reduce manufacturing cost by allowing the stop to be manufactured in one single piece of metal. However, other means of fabrication are also contemplated, as are known in the art.

In the present depth of drive assembly 10, the ears 72 are also configured for facilitating easy removal of the assembly 10 from the tool 12. By loosening the fasteners 64 from the nut block 68, the assembly 10 can be easily removed by pulling upward on the ears 72, in a direction perpendicular to the motion of the workpiece contact element 26 relative to the upper probe 18 of the tool 12. This motion causes the biasing element 34 to relieve compression on the assembly 10, thereby "unlocking" the assembly 10 from the tool 12.

To adjust the assembly 10 relative to the tool 12, the operator grasps one or both of the ears 72 and pulls the stop 32 normally relative to the axis of the workpiece contact element 26. The pulling action overcomes the force exerted by the biasing element 34, and allows the adjustment end 28 to slide relative to the teeth 40, since the teeth 38 are disengaged from the teeth 40. Pulling or pushing the workpiece contact element 26 relative to the stop 32 and the upper probe 18 adjusts the depth-of-drive of the tool 12. Upon user release of the stop 32, the biasing element 34 urges the stop against the adjustment end 28, and the teeth 38, 40 remesh. The workpiece contact element 26 remains in its new or locked position because of the positive engagement between the teeth 38, 40. Also, the adjustment is accomplished without the use of tools.

To more accurately determine the desired depth-of-drive, the present assembly 10 further includes a depth indicator scale 80 located on a top surface 82 of the workpiece contact element 26. The scale 80 is configured to correspond with a pointer 84 extending outwardly from a front end 86 of the stop 32, which shows the depth-of-drive. In conventional units, known depth indicators were generally located on the lower end of the lower probe. Therefore, it was difficult for the operator to accurately determine the correct direction of adjustment to obtain a desired change in the depth of drive. However, in the present invention, there is a direct relationship between the depth indicator scale 80 and the pointer 84 because the workpiece contact element 26 and the stop 32 are connected to each other. The scale 80 also preferably includes graphical elements 88 which assist the user in determining the relationship between adjustment in length of the workpiece contact element 26 and fastener depth.

Aside from accompaniment with new tools, it is also contemplated that the present depth of drive assembly 10 may be provided as a kit for repairing or retrofitting an existing fastener-driving tool. Because workpiece contact elements tend to need replacement before the rest of the fastener-driving tool, a kit that allows replacement of the workpiece contact element on its own provides a cost-effective solution to normal tool wear. Such a kit includes a workpiece contact element 26 having an adjustment end 28 and a contact end 30. The kit further includes a stop 32 configured to be removably secured to the workpiece contact element 26, a biasing element 34 configured to be placed on a top side of the stop 32, and a spacer 36. The spacer 36 includes a base 42 configured for receiving the biasing element 34, the stop 32 and the workpiece contact element 26, through their respective openings. Finally, the kit optionally includes a pair of fasteners 56 configured for securing the kit to the tool 12, and a nut block 68. The kit is installed by removing the existing workpiece contact element 26 and associated depth-of-drive components and replacing them with the assembly 10 as described above.

While a particular embodiment of the present tool-free depth of drive assembly for a fastener-driving tool has been described herein, it will be appreciated by those skilled in the art that changes and modifications may be made thereto without departing from the invention in its broader aspects and as set forth in the following claims.

The invention claimed is:

1. An adjustable depth of drive assembly for use with a fastener-driving tool, said assembly comprising:

a workpiece contact element having a contact end and an adjustment end;

at least one stop configured for being secured to the tool and being normally moveable between an adjusting position in which said workpiece contact element is movable relative to the tool, and a locked position wherein said adjustment end is secured from movement relative to the tool;

at least one biasing element associated with the stop and configured for urging the stop and the adjustment end into a selected locked position relative to the tool without the use of tools; and a spacer having a base, wherein said adjustment end of said workpiece contact element has an opening configured for receiving said spacer base.

2. The assembly of claim 1 wherein said assembly is configured for being fastened to a platform of an upper probe of said fastener-driving tool.

3. The assembly of claim 1 wherein said adjustment end of said workpiece contact element has at least one toothed edge, and said stop has at least one corresponding toothed surface for positively engaging said adjustment end teeth in one of a plurality of selected adjustment positions.

4. The assembly of claim 3 wherein said stop has a depending skirt and said at least one toothed surface is disposed on said skirt.

5. The assembly of claim 4 wherein two, generally parallel side edges of said adjustment end are toothed, and said skirt is provided with teeth for engaging both of said edges.

6. The assembly of claim 1 wherein said stop has an opening configured to be in registry with said opening in said workpiece contact element.

7. The assembly of claim 6 wherein said biasing element has an opening configured to be in registry with said opening in said stop.

8. The assembly of claim 7 wherein said base of said spacer is configured for being received by said opening in said biasing element, said stop opening, and said workpiece contact element opening.

9. The assembly of claim 1 wherein said at further comprising a pair of ears located on a pair of said stop, and extended outwardly from said stop.

10. The essembly of claim 1 wherein said workpiece contact element further comprises a depth indicator scale located on a top portion of said workpiece contact element.

11. The assembly of claim 10 further including a pointer extended outwardly from a front end of said stop, and wherein said depth indicator scale is configured to correspond with said pointer.

12. An adjustable depth of drive assembly for use with a fastener-driving tool, said assembly comprising:

a workpiece contact element having a contact end and an adjustment end at least one stop configured for being secured to the tool and being normally moveable between an adjusting position in which said workpiece contact element is movable relative to the tool, and a locked position wherein said adjustment end is secured from movement relative to the tool:

at least one biasing element associated with the stop and configured for urging the stop and the adjustment end into a selected locked position relative to the tool without the use of tools; and a spacer, wherein said spacer includes a flange, a base, and a pair of holes extending through said base.

13. The assembly of claim 12 wherein said flange of said spacer includes at least one stop extending axially from said flange.

14. The assembly of claim 13 wherein said at least one stop is configured to abut against a beauty ring of said fastener-driving tool.

15. The assembly of claim 12 wherein said assembly further comprises a pair of fasteners configured for being inserted into said pair of holes, wherein said fasteners are configured for fastening said assembly to an upper probe platform of said fastener-driving tool.

16. An adjustable depth of drive assembly for use with a fastener-driving tool, said assembly comprising:

a workpiece contact element having a contact end and an adjustment end having at least one toothed edge;

a stop configured for being removably engageable with said workpiece contact element and having a depending skirt with at least one toothed surface configured for releasably engaging said at least one toothed edge;

a biasing element configured for exerting a biasing force against said stop for urging said stop into engagement with said workpiece contact element; and a spacer having a flange configured for compressing said biasing element against said stop, and wherein said stop is configured to be pulled by a user towards said flange to release said stop from engagement with said at least one toothed edge.

17. The assembly of claim 16 wherein said adjustment end has a pair of opposed, parallel toothed edges, and said skirt has toothed surfaces for releasably engaging said edges.

18. An adjustable depth of drive assembly kit for use with a fastener-driving tool, comprising:

a workpiece contact element having a contact end, an adjustment end, and an opening at said adjustment end;

a stop configured to be removably secured to said workpiece contact element and having an opening corresponding to said workpiece contact element opening, a pair of ears located on a pair of opposite sides of said stop;

a biasing element configured to be placed on a top side of said stop, said biasing element having an opening corresponding to said stop opening; and a spacer having a pair of through holes, a flange, at least one stop extending axially from said flange, and a base extending downward from said flange, said base configured to receive each of said biasing element opening, said stop opening, and said workpiece contact element opening.

19. The assembly of claim 18 further including a pointer extending from a front end of said stop, said pointer configured to correspond to a depth indicator scale located on a top part of said workpiece contact element.

20. The assembly of claim 18 further including at least one fastener configured for being inserted into said pair of through holes, said at least one fastener configured for securing said kit to said fastener-driving tool.

* * * * *